US010895058B2

(12) United States Patent
Kerestes

(10) Patent No.: US 10,895,058 B2
(45) Date of Patent: Jan. 19, 2021

(54) APPARATUS FOR FACILITATING PIVOTAL MOVEMENT OF IMPLEMENTS IN MACHINES

(71) Applicant: Caterpillar Inc., Deerfield, IL (US)

(72) Inventor: Chad William Kerestes, Oglesby, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/275,407

(22) Filed: Feb. 14, 2019

(65) Prior Publication Data

US 2020/0263383 A1 Aug. 20, 2020

(51) Int. Cl.

| | |
|---|---|
| ***E02F 3/36*** | (2006.01) |
| ***E02F 3/32*** | (2006.01) |
| ***E02F 3/38*** | (2006.01) |
| ***E02F 9/00*** | (2006.01) |
| ***E02F 9/22*** | (2006.01) |

(52) U.S. Cl.

CPC ..... *E02F 3/3677* (2013.01); *E02F 3/32* (2013.01); *E02F 3/38* (2013.01); *E02F 9/006* (2013.01); *E02F 9/2271* (2013.01)

(58) Field of Classification Search

CPC ... E02F 3/32; E02F 3/36; E02F 3/3677; E02F 3/38

See application file for complete search history.

(56) References Cited

U.S. PATENT DOCUMENTS 4,299,290 A * 11/1981 Nunes, Jr. ..... E02F 3/847 172/4.5

FOREIGN PATENT DOCUMENTS

| | | |
|---|---|---|
| CA | 2082028 | 10/1995 |
| CN | 204267510 U | 4/2015 |
| CN | 205934999 U | 2/2017 |
| CN | 206916812 | 1/2018 |
| CN | 206916812 U | 1/2018 |
| CN | 105804133 | 11/2018 |
| JP | 2000144800 A | 5/2000 |
| JP | 2002179382 A | 6/2002 |
| JP | 2006152589 A | 6/2006 |
| KR | 20100091717 | 8/2010 |

* cited by examiner

*Primary Examiner* — Ronald P Jarrett

(74) *Attorney, Agent, or Firm* — Oblon, McClelland, Maier & Neustadt

(57) ABSTRACT

An apparatus for facilitating a pivotal movement of an implement relative to an arm of a machine includes a link. The link includes a first end segment, a second end segment, and an intermediate segment extending therebetween. Each of the first end segment and the second end segment includes an eyelet portion, and a stub portion that extends integrally and contiguously from the eyelet portion. The intermediate segment is coupled to the stub portion of the first end segment and to the stub portion of the second end segment.

15 Claims, 5 Drawing Sheets

APPARATUS FOR FACILITATING PIVOTAL MOVEMENT OF IMPLEMENTS IN MACHINES

TECHNICAL FIELD

The present disclosure relates to an apparatus, such as a power link, that facilitates a pivotal movement of an implement relative to an arm of a machine. More particularly, the present disclosure relates to the apparatus' structure and configuration that enhances a structural rigidity of the apparatus.

BACKGROUND

A machine, such as an excavator, generally includes an arm, and an implement (e.g., a bucket) that may be pivoted relative to the arm to perform useful work. Generally, the implement is pivoted relative to the arm through the actuating action of an actuator (e.g., a hydraulic actuator). The actuator typically uses an apparatus, commonly referred to as a power link, to facilitate the pivotal movement of the implement relative to the arm. According to one example, one end of the apparatus may be coupled to the actuator while the other end may be coupled to the implement, and, in that manner, a movement imparted by the actuator to the apparatus may be passed to the implement, causing the implement to pivot relative to the arm.

Often, the implement is required to execute various strenuous tasks at a worksite. For example, if the implement were to include a bucket, the bucket may need to be manipulated to dig, draw, scoop, extract, and dump, a quantity of material at one or more specified locations of the worksite. During the execution of such strenuous tasks, the actuator may repeatedly cause the apparatus to be moved, pulled, pushed, etc., thus subjecting the apparatus to a variety of loads. Such loads reduce a work life of the apparatus, leading to frequent repairs and/or replacements of the apparatus, thus incurring cost and machine downtime.

Chinese Patent No. 206916812 relates to a novel X-shaped I-shaped structural connecting rod. The connecting rod includes a shaft tube, a pair of shaft tubes positioned oppositely to the shaft tube, two outer ribs coupled between the shaft tube and the pair of shaft tubes, and two bending ribs (also) coupled between the shaft tube and the pair of shaft tubes. The outer ribs are located on the left side and the right side of the connecting rod, while the two bending ribs are integrally formed to form an X-shaped structure to ensure that a force may be uniformly transmitted to the entire connecting rod.

SUMMARY OF THE INVENTION

In one aspect, the disclosure is directed towards an apparatus for facilitating a pivotal movement of an implement relative to an arm of a machine. The apparatus includes a link. The link includes a first end segment, a second end segment, and an intermediate segment extending therebetween. Each of the first end segment and the second end segment includes an eyelet portion, and a stub portion that extends integrally and contiguously from the eyelet portion. The intermediate segment is coupled to the stub portion of the first end segment and to the stub portion of the second end segment.

In another aspect, the disclosure relates to a linkage assembly for manipulating an implement relative to a frame of a machine. The linkage assembly includes an arm, an actuator, and an apparatus. The arm is adapted to be pivotably coupled to the implement, while the actuator is movably coupled to the arm. The apparatus is pivotably coupled to the actuator and is adapted to be pivotably coupled with the implement to facilitate a pivotal movement of the implement relative to the arm based on an actuating action of the actuator. The apparatus includes a link with a first end segment, a second end segment, and an intermediate segment extending therebetween. Each of the first end segment and the second end segment includes an eyelet portion, and a stub portion extending integrally and contiguously from the eyelet portion. The intermediate segment is coupled to the stub portion of the first end segment and to the stub portion of the second end segment.

In yet other aspects, the disclosure is directed to a machine. The machine includes a frame, an arm, an implement, an actuator, and an apparatus. The arm is movably coupled relative to the frame. The implement is pivotably coupled to the arm, and is adapted to perform a work function. The actuator is movably coupled to the arm, and is adapted to controllably manipulate the implement relative to the arm. Further, the apparatus is pivotably coupled to the actuator and to the implement to facilitate a pivotal movement of the implement relative to the arm based on an actuating action of the actuator. The apparatus includes at least two links that are parallelly disposed and spaced apart from each other. Each link includes a first end segment, a second end segment, and an intermediate segment extending therebetween. Each of the first end segment and the second end segment includes an eyelet portion, and a stub portion extending integrally and contiguously from the eyelet portion. For each link, the intermediate segment is coupled to the stub portion of the first end segment and to the stub portion of the second end segment by groove welding.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
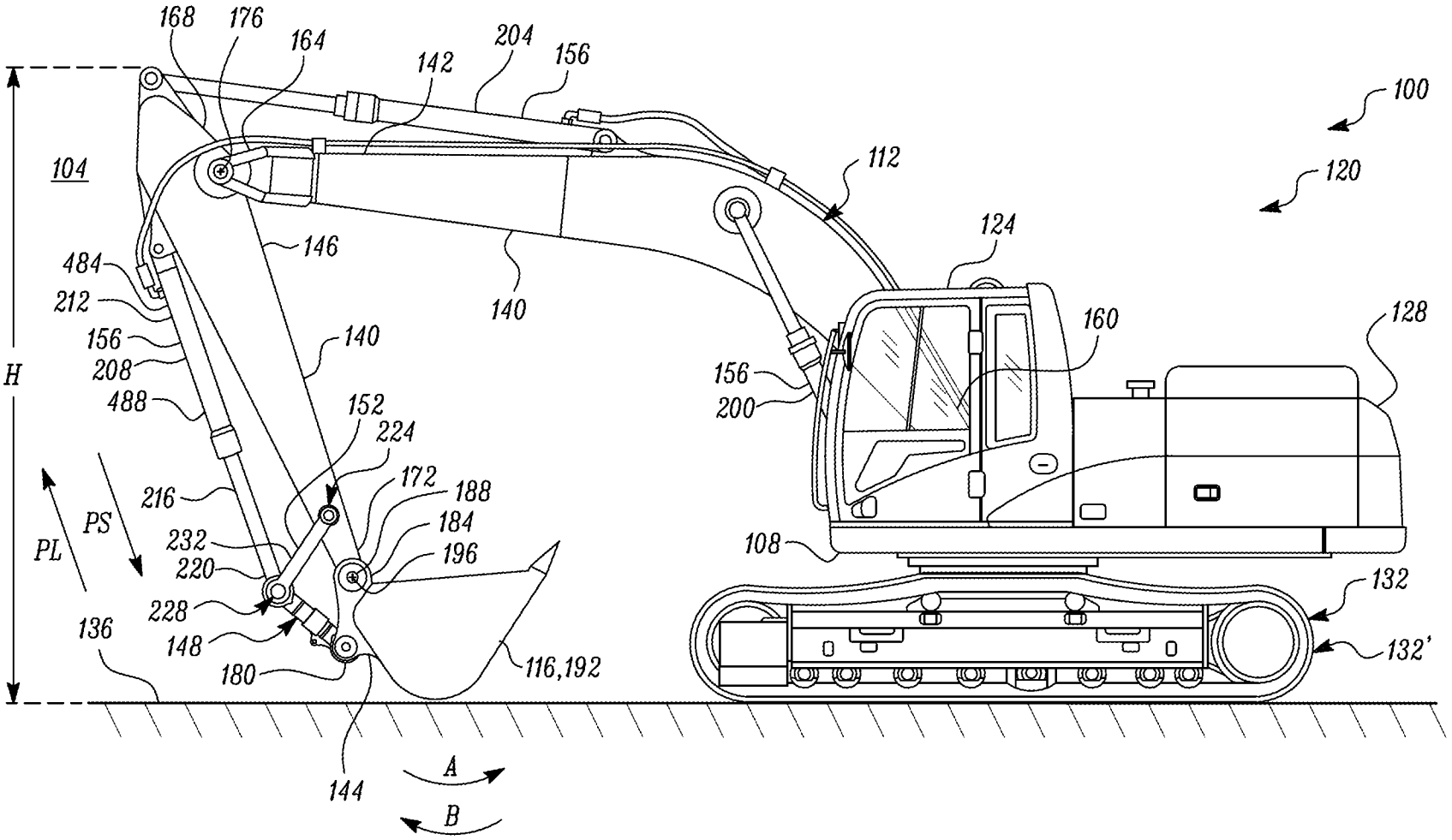
FIG. 1 is an exemplary machine including a linkage assembly, in accordance with an embodiment of the present disclosure.

Referring to FIG. 1, a machine 100 is shown. The machine 100 may be configured to perform multiple operations at a worksite 104, such as loading and unloading of a variety of materials. Materials may include, but are not limited to, boulders, trees, structural components, rocks, soil, disintegrated particles, etc. As shown, the machine 100 includes a frame 108, a linkage assembly 112, and an implement 116. The linkage assembly 112 and the implement 116 may work in concert to perform one or more of the aforementioned operations at the worksite 104. The machine 100 may be an excavator 120, as shown. However, concepts of the present disclosure may also be applicable to a number of other work machines, and are not limited to the excavator 120. For example, machines such as forest machines, shovels, backhoe loaders, etc., may also make use of the details and discussions discussed herein.

The frame 108 may include a rigid structure to which nearly every other component (and/or sub-component) of the machine 100 may be coupled to. For example, the frame 108 may support an operator cab 124 that may be used to accommodate one or more operators of the machine 100 for the control of the many functions of the machine 100. The frame 108 may further support a counterweight 128 that provides stability to the machine 100 during operation. The frame 108 may be rotatably supported on a powertrain unit 132 (e.g., a lower powertrain unit 132') of the machine 100. The powertrain unit 132 may lie in engagement with a ground surface 136, facilitating machine mobility on (and relative to) the ground surface 136.

Figure 2:
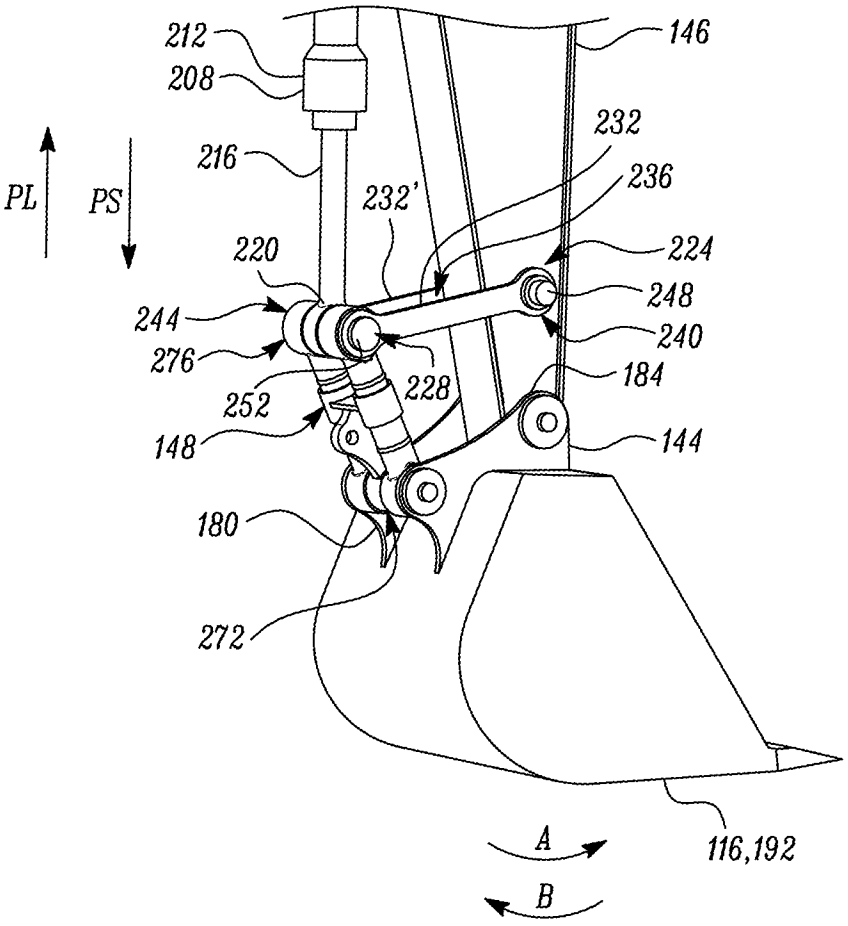
FIG. 2 is a portion of an arm of the linkage assembly disposed remote to a frame of the machine, with an implement being pivotably coupled to the arm, in accordance with an embodiment of the present disclosure.

Referring to FIGS. 1 and 2, the linkage assembly 112 may be applied to manipulate the implement 116 relative to the frame 108 of the machine 100. To this end, the linkage assembly 112 may include arms 140 a bracket 144 configured to couple the implement 116 to one of the arms 140, an apparatus 148 to facilitate a pivotal movement of the implement 116 relative to one of the arms 140, a swivel guide unit 152 to support the apparatus 148, and a number of actuators 156 adapted to actuate and move the arms 140 and the implement 116 between a variety of configurations. Details of each of these will now be discussed.

The arms 140 may include or may be individually categorized into a stick 146 and a boom 142. Both the stick 146 and boom 142 may be generally rigidly formed, elongated members that may be pivotably coupled to each other. The boom 142 may define a first boom end 160 and a second boom end 164 disposed opposite to the first boom end 160. Similarly, the stick 146 may define a first stick end 168 and a second stick end 172 disposed opposite to the first stick end 168. Although the stick 146 and the boom 142 may generally constitute the arms 140 of the linkage assembly 112, it is possible for the linkage assembly 112 to include additional or lesser number of arms, and/or other devices.

The boom 142 may be movably or pivotably coupled to the frame 108. For example, the first boom end 160 may be pivotably coupled to the frame 108, while the second boom end 164 may be generally disposed away from the frame 108. According to the example illustrated, the second boom end 164 may be pivotably coupled to the stick 146 (e.g., to the first stick end 168 of the stick 146). In so doing, the boom 142 (in conjunction with the stick 146) may pivot relative to the frame 108. According to an example, the boom 142 may pivot relative to the frame 108 about a boom axis (not shown) disposed generally horizontally with respect to the ground surface 136. The stick 146, being coupled to the boom 142 at the first stick end 168, may be pivotable relative to the boom 142 about a stick axis 176. In some implementations, the stick axis 176 may be parallel to the boom axis.

The bracket 144 may include a first yoke portion 180 and a second yoke portion 184. The second yoke portion 184 may be pivotably coupled to the second stick end 172, and thus may facilitate the bracket 144 to pivot relative to the stick 146. In an embodiment, the second yoke portion 184 may receive the second stick end 172, and a pin 188 may be passed through the second yoke portion 184 and the second stick end 172 and rotatably retained therein so as to pivotably couple the second yoke portion 184 with the second stick end 172, in turn pivotably coupling the bracket 144 with the stick 146.

The implement 116 may be fixedly coupled (e.g., by welding) to the bracket 144, and thus a pivotal movement of the bracket 144 relative to the stick 146 may translate into the pivotal movement of the implement 116 relative to the stick 146. The implement 116, according to an aspect of the present disclosure, includes a bucket 192. However, the implement 116 may also represent and/or may include various other work tools, such as a hammer, a grapple, a ram, a fork, a thumb, and similar such tools, to perform various operations. Although not limited, the implement 116 may be pivotable relative to the stick 146 about an implement axis 196 that may be parallel to the stick axis 176.

The actuators 156 may be three in number according to the aspects described herein. However, depending upon the overall design and layout of the linkage assembly 112, an area of application of the machine 100, a type of the machine 100, etc., the number of actuators 156 may change. Therefore, additional or lesser number of actuators 156 may be contemplated. For ease in referencing, the three actuators 156 are individually referred to as a boom actuator 200, a stick actuator 204, and an implement actuator 208. According to one example, each of the boom actuator 200, the stick actuator 204, and the implement actuator 208, may work on hydraulic actuation principles, and may include a cylinder-rod based arrangement. For example, each of the boom actuator 200, the stick actuator 204, and the implement actuator 208, may include a cylinder (e.g., see cylinder 212 associated with the implement actuator 208) and a rod (e.g., see rod 216 associated with the implement actuator 208). The rod may be telescopically extendable and retractable relative to the cylinder based on the pressurized influx/release of a hydraulic fluid into/out the cylinder.

The boom actuator 200 may be operably and pivotably coupled between the boom 142 and the frame 108. In that manner, the boom actuator 200 may facilitate an actuation and a pivotal movement of the boom 142 with respect to the frame 108 about the boom axis. Said pivotal movement may be executed along a height, H, of the machine 100, helping raise and lower the linkage assembly 112 as a whole (along with the implement 116) relative to the frame 108. The stick actuator 204 may be operably coupled between the boom 142 and the stick 146, and may facilitate a pivotal motion of the stick 146 with respect to the boom 142 about the stick axis 176.

The implement actuator 208 may be operably and pivotably coupled between the stick 146 and the bracket 144, so as to actuate or power the pivotal movement of the bracket 144 (and thus of the implement 116) with respect to the stick 146. For example, die cylinder 212 of the implement actuator 208 may be coupled to the stick 146, while the rod 216 of the implement actuator 208 may be extendable and retractable relative to the cylinder 212, as noted above. An end 220 of the rod 216 may be operably coupled (i.e., via the apparatus 148) to the bracket 144 to cause the pivotable movement of the bracket 144 (and thus of the implement 116) relative to the stick 146 based on the implement actuator 208's actuation.

The swivel guide unit 152 may be pivotably coupled to a portion 224 of the stick 146 (e.g., the portion 224 is disposed relatively close to the second stick end 172 as shown in FIGS. 1 and 2) and may also be pivotably coupled to the end 220 of the rod 216, thus defining a pivot joint 228 with respect to the rod 216. In that manner, the swivel guide unit 152 may support and guide the end 220 of the rod 216, thereby also supporting and guiding the implement actuator 208 with respect to the stick 146. According to the depicted embodiment, the swivel guide unit 152 includes dual guide arms, namely a first guide arm 232 and a second guide arm 232'. The first guide arm 232 and the second guide arm 232' are identical and are parallelly disposed with respect to each other, and define a space 236 therebetween (see FIG. 2). The first guide arm 232 and the second guide arm 232' combinedly define a first guide end 240 of the swivel guide unit 152 and a second guide end 244 of the swivel guide unit 152. The first guide arm 232 and the second guide arm 232' may receive the portion 224 of the stick 146 into the space 236 from the first guide end 240, and may receive the end 220 of the rod 216 into the space 236 from the second guide end 244. Further, the first guide arm 232 and the second guide arm 232' may also be rotatably (i.e., pivotably) retained with respect to each of the portion 224 of the stick 146 and to the end 220 of the rod 216 by use of respective pins 248, 252.

Referring to FIGS. 2, 3, 4, and 5, the apparatus 148 is coupled between the rod 216 and the bracket 144, and facilitates the pivotal movement of the bracket 144 (and thus of the implement 116) relative to the stick 146. In structure and construction, the apparatus 148 includes a plurality of links—namely a first link 264 and a second link 268—additional or lesser number of links may be contemplated. The first link 264 and the second link 268 are identical to each other. Also, the second link 268 is spaced apart from the first link 264, and is disposed parallelly with respect to the first link 264.

The first link 264 and the second link 268 together define a first apparatus end portion 272 and a second apparatus end portion 276 of the apparatus 148. The first apparatus end portion 272 may be pivotably coupled to the first yoke portion 180 of the bracket 144, while the second apparatus end portion 276 may be pivotably coupled to the pivot joint 228, thus making the pivot joint 228 a common point of intersection between the rod 216, the swivel guide unit 152, and the apparatus 148, with each of the rod 216, the swivel guide unit 152, and the apparatus 148, being pivotable about a common axis of rotation defined by the pivot joint 228. It may be noted that the description further below includes various details associated with the first link 264. Such details may be suitably applicable for the second link 268 as well. For ease, the first link 264 may be simply referred to as a link 264. Wherever required, references to the first link 264 and the second link 268, and components related thereto, may be explicitly used. Further, since the first link 264 and the second link 268 are identical to each other, parts (of the second link 268) may be identified (or annotated) with the same reference numerals as have been used of the first link 264 suffixed with a prime.

Figure 3:
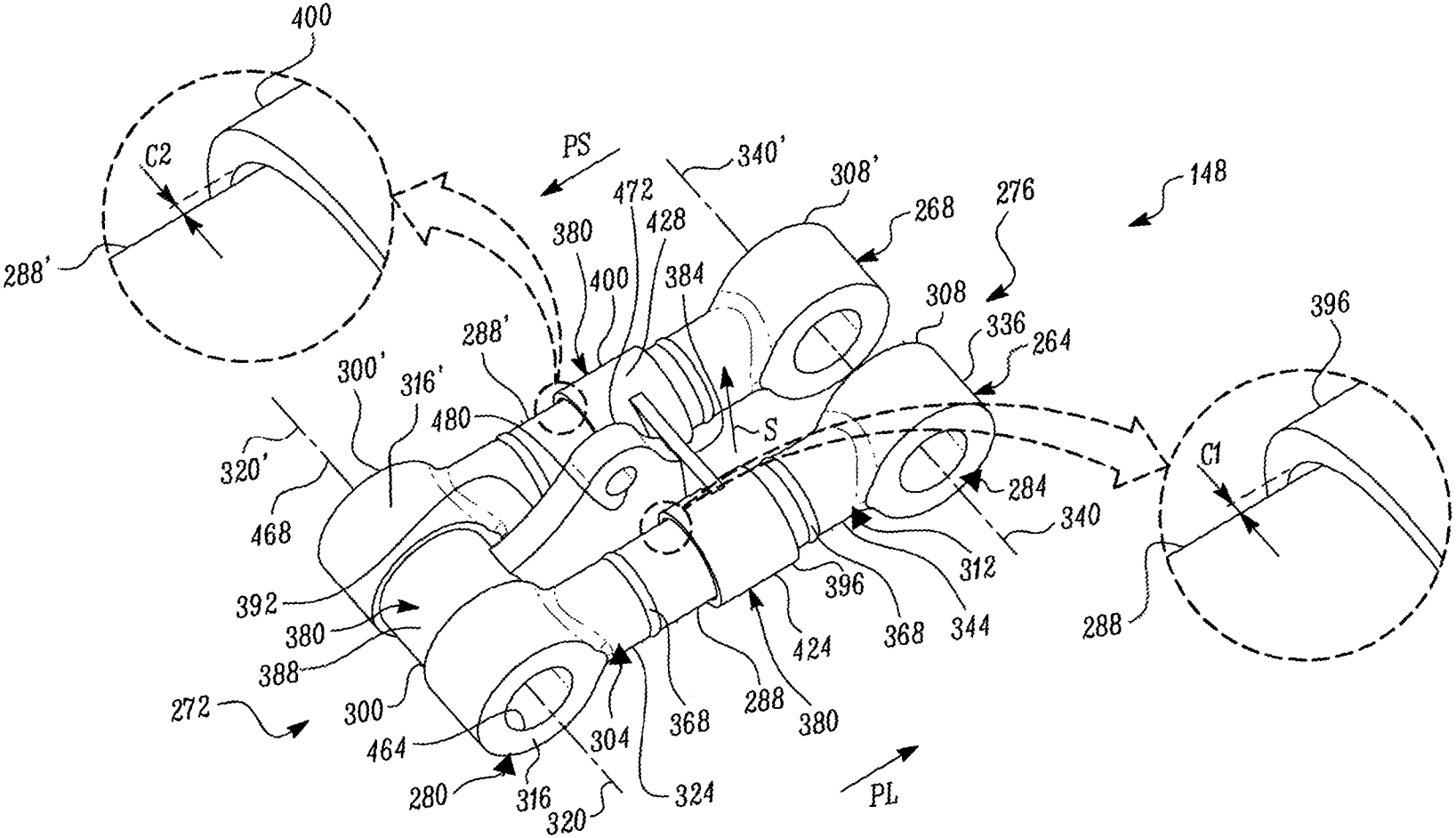
FIG. 3 is a perspective view of an apparatus that facilitates a pivotal movement of the implement relative to the arm, in accordance with an embodiment of the present disclosure.
Figure 4:
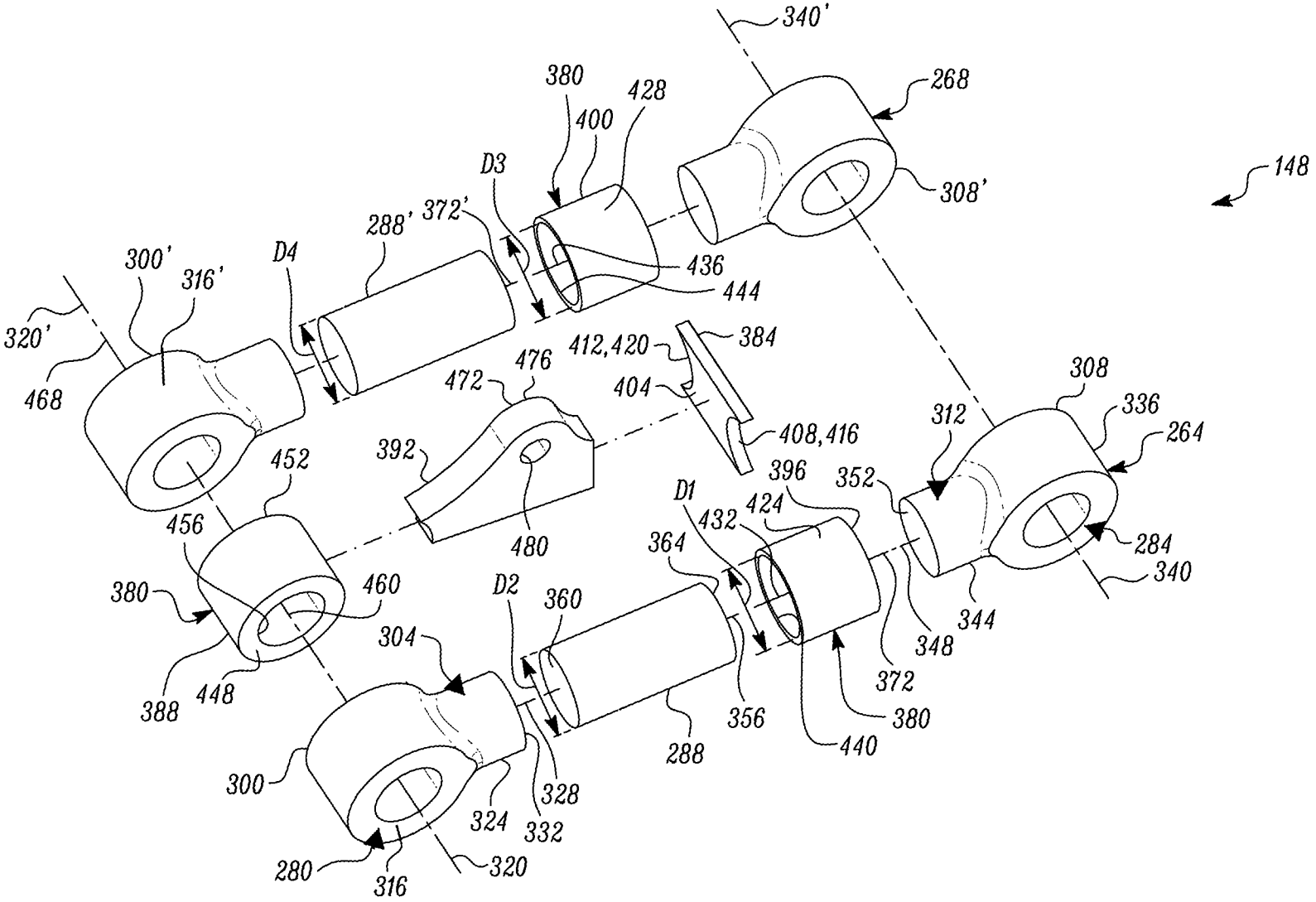
FIG. 4 is an exploded view of the apparatus, in accordance with an embodiment of the present disclosure.
Figure 5:
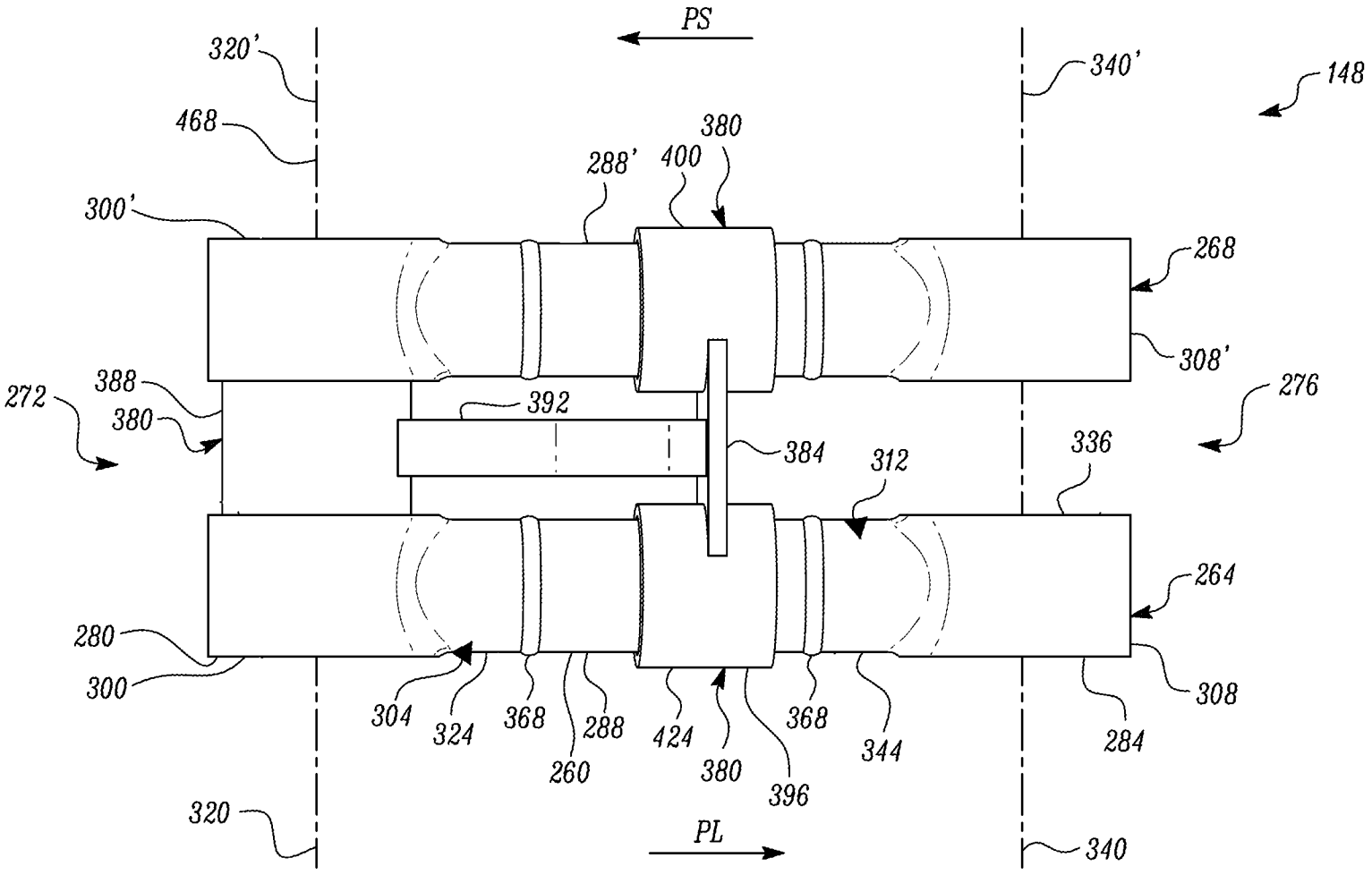
FIG. 5 is a top view of the apparatus, in accordance with an embodiment of the present disclosure.

Referring to FIGS. 3, 4, and 5, the link 264 includes a first end segment 280, a second end segment 284, and an intermediate segment 288. Each of the first end segment 280 and the second end segment 284 includes an eyelet portion and a stub portion that extends integrally and contiguously from the eyelet portion. For example, the first end segment 280 includes a first eyelet portion 300 and a first stub portion 304 extending integrally and contiguously from the first eyelet portion 300. Similarly, the second end segment 284 includes a second eyelet portion 308 and a second stub portion 312 extending integrally and contiguously from the second eyelet portion 308. According to an aspect of the present disclosure, a cross-sectional profile of the first stub portion 304 may be same (i.e., similarly dimensioned) as a cross-sectional profile of the second stub portion 312. While various cross-sectional profiles of the first stub portion 304 and the second stub portion 312 may be contemplated, according to one aspect of the present disclosure, the cross-sectional profiles of the first stub portion 304 and the second stub portion 312 may be circular—as may also be visualized from FIG. 4.

In one example, the first eyelet portion 300 may be eye-shaped, and may include a hollow cylindrical portion 316, defining a first eyelet axis 320, while the first stub portion 304 may include a solid cylindrical portion 324 defining a first stub axis 328. The first eyelet axis 320 may be perpendicular to the first stub axis 328. In other words, the first stub portion 304 may extend normally with respect to a curvature profile defined by the first eyelet portion 300. According to an example, the first stub portion 304 defines a first stub end face 332 remote to/away from the first eyelet portion 300.

Equivalent details may be contemplated for the second eyelet portion 308 vis-à-vis the second stub portion 312, as well. For example, the second eyelet portion 308 may be eye-shaped, and may include a hollow cylindrical portion 336, defining a second eyelet axis 340, while the second stub portion 312 may include a solid cylindrical portion 344 defining a second stub axis 348. The second eyelet axis 340 may be perpendicular to the second stub axis 348. In other words, the second stub portion 312 may extend normally with respect to a curvature profile defined by the second eyelet portion 308. According to an example, the second stub portion 312 defines a second stub end face 352 remote to/away from the second eyelet portion 308.

The first stub end face 332 and the second stub end face 352 may be respectively orthogonally disposed to the first stub axis 328 and the second stub axis 348. As the cross-sectional profiles of the first stub portion 304 and the second stub portion 312 are exemplified to be circular, the first stub end face 332 and the second stub end face 352 may be both circular as well. Further, since the cross-sectional profile of the first stub portion 304 may be same as the cross-sectional profile of the second stub portion 312, a size of the first stub end face 332 may be equal to a size of the second stub end face 352.

The intermediate segment 288 extends between the first end segment 280 and the second end segment 284. The intermediate segment 288 may be a generally tube-shaped, longitudinal member that extends along a longitudinal axis 356, and may include a cross-sectional profile that is similar to the cross-sectional profiles of the first stub portion 304 and the second stub portion 312. Therefore, as the cross-sectional profiles of the first stub portion 304 and the second stub portion 312 are shown to be circular, the cross-sectional profile of the intermediate segment 288 may be circular as well. Further, the cross-sectional profile of the intermediate segment 288 may be sized similarly to the cross-sectional profiles of the first stub portion 304 and the second stub portion 312, as well. In particular, the intermediate segment 288 defines a first end face 360 and an axially opposed, second end face 364. According to an example, the first end face 360 and the second end face 364 may be orthogonally disposed with respect to the longitudinal axis 356. Since the intermediate segment 288 is exemplified to include a circular cross-section, the first end face 360 and the second end face 364 of the intermediate segment 288 may be both circular as well, and each may be sized similarly as the first stub end face 332 and the second stub end face 352.

According to an aspect of the present disclosure, the intermediate segment 288 is coupled to the first stub portion 304 and to the second stub portion 312. For example, the first stub end face 332 may be coupled to the first end face 360 of the intermediate segment 288, while the second stub end face 352 may be coupled to the second end face 364 of the intermediate segment 288. Since the cross-sectional profiles of the first stub portion 304 and the second stub portion 312 are the same as the cross-sectional profile of the intermediate segment 288, a coupling between the intermediate segment 288, the first stub portion 304 (i.e., the first end segment 280), and the second stub portion 312 (i.e., the second end segment 284), imparts a generally continuous, uninterrupted, and smoothened silhouette to an outer surface of the link 264, reminiscent of a unitarily formed component. However, according to some embodiments, the intermediate segment 288 is coupled to the stub portion of the first end segment 280 (i.e., to the first stub portion 304) and to the stub portion of the second end segment 284 (i.e., to the second stub portion 312) by groove welding, and thus, a seam 368 (see FIGS. 3 and 5) of such a welded connection may exist between the intermediate segment 288 and the first stub portion 304, and between the intermediate segment 288 and the second stub portion 312. The seam 368 may be exaggerated in FIG. 3 for easy visualization and understanding. Other means of coupling the intermediate segment 288 with each of the first stub portion 304 (of the first end segment 280) and the second stub portion 312 (of the second end segment 284), such as by use of industrial adhesives, may also be contemplated. Further, in such coupling, the first stub axis 328, the longitudinal axis 356, and the second stub axis 348, may be each co-axial to each other. Combinedly, the first stub axis 328, the second stub axis 348, and the longitudinal axis 356, may define a link axis 372 of the link 264.

According to an example, if a welded connection were applied between the intermediate segment 288 and the first stub portion 304, the welded connection may include a fatigue protected groove welded (FPGW) connection or a stress protected groove weld (SPGW) connection. An FPGW connection or SPGW connection may mean that as the first stub end face 332 and the first end face 360 may be brought into contact with each other, the first stub end face 332 and the first end face 360 may combinedly define a seam (running azimuthally around an interface defined between the first stub end face 332 and the first end face 360) having a generally Y-shaped cross-section (i.e., a cross-section that defines a 'V-shaped profile' with a 'root' extending from an 'apex' of the 'V-shaped profile'). In other words, the seam may define an annular V-shaped portion with an annular root protrusion portion extending from the annular V-shaped portion. During welding, filler material may be received into the annular V-shaped portion and, at least in part, into the annular root protrusion portion. The annular root protrusion portion may be configured to locate a 'weld root' which corresponds to a negligible stress concentration zone isolated beyond and away from a stress flow path propagated through and across the intermediate segment 288 and the first stub portion 304 such that the 'weld root' may be well protected from fatigue failure. Similar discussions may be contemplated for the connection between the intermediate segment 288 and the second stub portion 312. In that manner, cyclic loading, forces, and/or stresses (including, at least in part, tensile or bending forces), acting on the link 264, may be suitably accommodated.

Since the first link 264 and the second link 268 are identical to each other, in an assembly of the first link 264 with the second link 268, the first eyelet axis 320 of the first link 264 may be disposed co-axially with a first eyelet axis 320' of the second link 268. Similarly, the second eyelet axis 340 of the first link 264 may be disposed co-axially with the second eyelet axis 340' of the second link 268. Further, since the first link 264 and the second link 268 may be disposed parallelly to each other, the link axis 372 of the first link 264 may be disposed parallelly to a link axis 372' of the second link 268.

Further, the apparatus 148 includes a support structure 380 for supporting and retaining the first link 264 with the second link 268. The support structure 380 includes a beam 384, a connector piece 388, a plate 392, a first sleeve 396, and a second sleeve 400. Details related to the support structure 380 will now be discussed.

The beam 384 is disposed between the first link 264 and the second link 268. For example, the beam 384 includes a planarly laid out, flat plate body 404 that is disposed at right angles to the link axis 372 and the link axis 372'. The flat plate body 404 of the beam 384 may define end portions, for example, a first end portion 408 and the second end portion 412 opposite the first end portion 408. The first end portion 408 includes a first cutout 416, while the second end portion 412 defines a second cutout 420. According to an embodiment, the first cutout 416 and the second cutout 420 include respective C-shaped profiles having mouths that face away from each other, as shown (see FIG. 4).

The first sleeve 396 includes an outer surface 424 that may be compliant with the first cutout 416, and may be received and retained (e.g., by welding), at least partly, within the first cutout 416. Similarly, the second sleeve 400 includes an outer surface 428 that may be compliant with the second cutout 420, and may be received and retained (e.g., by welding), at least partly, within the second cutout 420. In effect, the first sleeve 396 and the second sleeve 400 may be coupled to the beam 384. The first sleeve 396 and the second sleeve 400 may respectively define a first sleeve axis 432 and a second sleeve axis 436. Both the first sleeve axis 432 and the second sleeve axis 436 may be defined at right angles to the flat plate body 404 of the beam 384.

Further, the first sleeve 396 may define a first slot 440 (e.g., a circular slot) that may allow passage and/or accommodate a portion of the intermediate segment 288 of the first link 264, and, similarly, the second sleeve 400 may define a second slot 444 (e.g., a circular slot) that may allow passage and/or accommodate a portion of an intermediate segment 288' of the second link 268. According to some embodiments, the first slot 440 may define a diameter, D1, that is relatively larger than a diameter, D2, of the intermediate segment 288 of the first link 264. Therefore, a clearance, C1, is defined between the first sleeve 396 and the first link 264 (i.e., the intermediate segment 288 of the first link 264). Similarly, the second slot 444 may define a diameter, D3, that is relatively larger than a diameter, D4, of the intermediate segment 288' of the second link 268. Therefore, a clearance, C2, is defined between the second sleeve 400 and the second link 268 (i.e., the intermediate segment 288' of the second link 268). Effectively, the first sleeve 396 is disposed around the first link 264 with the clearance, C1, being defined with the first link 264, while the second sleeve 400 is disposed around the second link 268 with the clearance, C2, being defined with the second link 268. When the apparatus 148 is subjected to load, the clearance, C1, facilitates a (minimal) relative movement or slide between the first sleeve 396 and the first link 264, and, similarly, the clearance, C2, facilitates a (minimal) relative movement or slide between the second sleeve 400 and the second link 268, to accommodate the load. Such relative movements are possible since a rigid connection (of any form) between the first sleeve 396 and the first link 264, and between the second sleeve 400 and the second link 268, may be non-existent.

The connector piece 388 is disposed between the first eyelet portion 300 of the first link 264 and a first eyelet portion 300' of the second link 268. For example, the connector piece 388 may be ring shaped defining two oppositely disposed axial ends 448, 452. One axial end 448 may be welded to the first eyelet portion 300 of the first link 264, while the other axial end 452 may be welded to the first eyelet portion 300' of the second link 268. Therefore, the connector piece 388 is fixedly coupled between the first link 264 and the second link 268. According to an embodiment, the connector piece 388 may include a through-hole 456 that defines a through-hole axis 460. In assembly of the connector piece 388 with the first link 264 and the second link 268, the through-hole axis 460 may lie co-axially with the first eyelet axis 320 of the first eyelet portion 300 of the first link 264 and the first eyelet axis 320' of the first eyelet portion 300' of the second link 268. In some embodiments, the through-hole 456 may define a diameter that may be equal to a diameter of the hollow cylindrical portion 316 associated with the first eyelet portion 300 of the first link 264 and a hollow cylindrical portion 316' associated with the first eyelet portion 300' of the second link 268. In that manner, the hollow cylindrical portion 316 associated with the first eyelet portion 300 of the first link 264, the hollow cylindrical portion 316' associated with the first eyelet portion 300' of the second link 268, and the through-hole 456 of the connector piece 388 may all lie serially so as to define one continuous passage 464 having a common, passage axis 468 (see FIG. 3).

The plate 392 may be fixedly coupled between the connector piece 388 and the beam 384. For example, the plate 392 is disposed perpendicularly to the flat plate body 404 of the beam 384. Further, the plate 392 may also be disposed perpendicularly to the passage axis 468, and may take a position defined generally midway between the first link 264 and the second link 268, as shown. A connection of the plate 392 to the beam 384 and to the connector piece 388 may be attained by welding, although other means of connection are possible. The plate 392 may include a protuberance 472 (generally a warped portion relative to the remainder of the plate 392) (see FIG. 4) that is defined to extend along a plane of the plate 392. The protuberance 472 may extend up to an apex 476 where an opening 480 of the plate 392 may be defined. The opening 480 may be adapted to receive a tether or a cable for various applications.

While many components of the apparatus 148 have been disclosed to be connected to the other by welding, such components (or a set of components) may also be integrally formed with respect to one another. Further, it is also possible for one or more of the components, or portions of such components, to be omitted. In some cases, the incorporation of some additional components may be contemplated. For example, a connector piece (not shown) (similar to the connector piece 388), or any like component, may be disposed and/or fixedly coupled between the second eyelet portion 308 of the first link 264 and a second eyelet portion 308' of the second link 268, and which may serve to reinforce the overall structure of the apparatus 148.

INDUSTRIAL APPLICABILITY

During operation, an operator may actuate the implement actuator 208 to move the implement 116 between a first position and a second position. Both the first position and the second position may be contemplated as any two arbitrary implement positions between which the implement 116 may be swayed so as to perform useful work. As an example, the first position may be contemplated as a position where the rod 216 is in a retracted state relative to the cylinder 212, while the second position may be contemplated as a position where the rod 216 is in an extended state relative to the cylinder 212.

During the implement 116's movement from the first position to the second position, the cylinder 212 of the implement actuator 208 may receive an influx of fluid (e.g., from a head end 484 of the cylinder 212) that pressurizes the cylinder 212 and causes the rod 216 to move and extend away from the cylinder 212. As the end 220 of the rod 216 is pivotably coupled to apparatus 148, such extension of the rod 216 pushes the apparatus 148 in a direction towards the second stick end 172 of the stick 146, in turn urging the apparatus 148 to move and push the first yoke portion 180 of the bracket 144 (and thus the implement 116 fixedly coupled to the bracket 144). Because the apparatus 148 is guided and supported by the swivel guide unit 152 and because the bracket 144 is also pivotably coupled to the second stick end 172 at the second yoke portion 184, the push (or the pushing action) (see direction, PS) induced by the rod 216 inevitably causes the bracket 144 to pivot relative to the second stick end 172 of the stick 146 along direction, A (see FIGS. 1 and 2). Accordingly, and in response, the implement 116 also pivots relative to the second stick end 172 of the stick 146 towards the second position along direction, A.

During the implement 116's return from the second position to the first position, an influx of the fluid (e.g., from a rod end 488 of the cylinder 212) may pressurize the cylinder 212, causing the rod 216 to move and retreat relative to (or into) the cylinder 212. As the rod 216 retreats, the end 220 of the rod 216 pulls the apparatus 148 towards the first stick end 168 of the stick 146. Because of the connections existing between the apparatus 148, the swivel guide unit 152, the rod 216, and the bracket 144, the pull (or the pulling action) (see direction, PL) induced by the rod 216 inevitably causes the bracket 144 to pivot relative to the second stick end 172 of the stick 146 in a direction, B, reversed to direction, A. Accordingly, the implement 116 also pivots relative to the second stick end 172 of the stick 146 along direction, B, and returns to the first position.

According to an example, the apparatus 148 facilitates a generally wide degree of pivotal movement of the implement 116 with respect to the stick 146 (or to the second stick end 172 of the stick 146) when actuated by the implement actuator 208—this wide degree of pivotal movement (i.e., a travel between the first position and the second position) may range up to 270 degrees (or more) about the implement axis 196, in certain cases. With such pivoting action, the implement 116 may execute the many functions of digging, drawing, scooping, extracting, and dumping, at the worksite 104.

According to some further embodiments, the linkage assembly 112 or the stick 146 may also need to be suspended, supported, and/or stationed in a particular configuration at the worksite 104, so as to accomplish certain other functions associated with the machine 100 at the worksite. To move and position the linkage assembly 112 or the stick 146 in such configurations, an arrangement comprising a cable or a tether (not shown) may be used. Such a cable or a tether may be passed through the opening 480 formed in the protuberance 472 and such a cable or a tether may be restrained to an auxiliary structure (not shown) so as to help the linkage assembly 112 or the stick 146 attain the required configuration. The need to move the linkage assembly 112 or the stick 146 of the linkage assembly 112 to such configurations, by engaging a cable or a tether through the opening 480, causes stresses to be induced into the apparatus 148, which, for example, may be generally defined along a plane of the plate 392 and perpendicularly in relation to the link axis 372, 372' (see direction, S, FIG. 3).

Repetitive pushing and pulling of the apparatus 148 by the frequent extension and retraction of the rod 216 to pivot the implement 116 about the implement axis 196, and the need to (possibly occasionally) engage the opening 480 (by cable or tether) subjects the apparatus 148 to the unappeasable loads and ensuing stresses. The apparatus 148, as disclosed in the present disclosure, includes a stronger and durable structure than what is available in conventional practice, so as to suitably accommodate the many unappeasable loads and stresses of operation.

More particularly, with the connection (e.g., the welded connection such as the fatigue protected groove welded connection or the stress protected groove welded connection) of the intermediate segment 288 to the first stub portion 304 and to the second stub portion 312, and with a similar scheme being applied to the second link 268, the apparatus 148 is adapted to ably accommodate the frequent pulling action (direction, PL) and pushing action (direction, PS) of the rod 216. Moreover, with the intermediate segment 288 defining the clearance, C1, with the first sleeve 396 and the intermediate segment 288' defining a clearance, C2, with the second sleeve 400, if a load (or a component of load) were to act along direction, S, both the intermediate segment 288 and the intermediate segment 288' would be able to (minimally) flex and/or slide relative to (and independent of) the first sleeve 396 and second sleeve 400, owing to the clearances C1 and C2, to accommodate said load. During the subjection of loads along direction, S, it may be noted that the first sleeve 396 and second sleeve 400 may also respectively prevent the intermediate segment 288 and the intermediate segment 288' from gaining excessive flexures so as to prevent structural deformations or fractures. Effectively, the structure of the apparatus 148, as discussed above, improves the overall strength and stiffness of the apparatus 148 and maintains unity and integrity of the apparatus 148. Further repeatability and workability of the apparatus 148 is enhanced, leading to reduced machine downtime and improved worksite productivity.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. An apparatus for facilitating a pivotal movement of an implement relative to an arm of a machine, the apparatus comprising:

a first link including a first end segment, a second end segment, and an intermediate segment extending therebetween, each of the first end segment and the second end segment including an eyelet portion and a stub portion extending integrally and contiguously from the eyelet portion;

a second link identical to the first link, the second link being spaced apart and disposed parallelly relative to the first link; and a support structure to support the first link with the second link, wherein the intermediate segment is coupled to the stub portion of the first end segment and to the stub portion of the second end segment, and wherein the support structure includes:

a beam disposed between the first link and the second link, a first sleeve coupled to the beam and disposed around the first link with a first clearance being defined with the first link, and a second sleeve coupled to the beam and disposed around the second link with a second clearance being defined with the second link.

2. The apparatus of claim 1, wherein the support structure further includes a connector piece fixedly coupled between the first link and the second link.

3. The apparatus of claim 2, wherein the support structure further includes a plate fixedly coupled between the connector piece and the beam, the plate including an opening adapted to receive a tether or a cable.

4. The apparatus of claim 1, wherein the intermediate segment is coupled to the stub portion of the first end segment and to the stub portion of the second end segment by groove welding.

5. The apparatus of claim 1, wherein a cross-sectional profile of the stub portion of the first end segment and a cross-sectional profile of the stub portion of the second end segment is the same as a cross-sectional profile of the intermediate segment.

6. The apparatus of claim 1, wherein a cross-sectional profile of the stub portion of the first end segment, a cross-sectional profile of the stub portion of the second end segment, and a cross-sectional profile of the intermediate segment, is circular.

7. A linkage assembly for manipulating an implement relative to a frame of a machine, the linkage assembly comprising:

an arm adapted to be pivotably coupled to the implement;

an actuator movably coupled to the arm;

an apparatus pivotably coupled to the actuator and adapted to be pivotably coupled with the implement to facilitate a pivotal movement of the implement relative to the arm based on an actuating action of the actuator, the apparatus including:

a first link including a first end segment, a second end segment, and an intermediate segment extending therebetween, each of the first end segment and the second end segment including an eyelet portion, and a stub portion extending integrally and contiguously from the eyelet portion, a second link identical to the first link, the second link being spaced apart and disposed parallelly relative to the first link, and a support structure to support the first link with the second link, wherein the intermediate segment is coupled to the stub portion of the first end segment and to the stub portion of the second end segment, and wherein the support structure includes:

a beam disposed between the first link and the second link, a first sleeve coupled to the beam and disposed around the first link with a first clearance being defined with the first link, and a second sleeve coupled to the beam and disposed around the second link with a second clearance being defined with the second link.

8. The linkage assembly of claim 7, wherein the support structure further includes a connector piece fixedly coupled between the first link and the second link.

9. The linkage assembly of claim 8 wherein the support structure further includes a plate fixedly coupled between the connector piece and the beam, the plate including an opening adapted to receive a tether or a cable.

10. The linkage assembly of claim 7, wherein the intermediate segment is coupled to the stub portion of the first end segment and to the stub portion of the second end segment by groove welding.

11. The linkage assembly of claim 7, wherein a cross-sectional profile of the stub portion of the first end segment and a cross-sectional profile of the stub portion of the second end segment is the same as a cross-sectional profile of the intermediate segment.

12. The linkage assembly of claim 7, wherein a cross-sectional profile of the stub portion of the first end segment, a cross-sectional profile of the stub portion of the second end segment, and a cross-sectional profile of the intermediate segment, is circular.

13. A machine, comprising:

a frame;

an arm movably coupled relative to the frame;

an implement pivotably coupled to the arm, and adapted to perform a work function;

an actuator movably coupled to the arm, and adapted to controllably manipulate the implement relative to the arm;

an apparatus pivotably coupled to the actuator and to the implement to facilitate a pivotal movement of the implement relative to the arm based on an actuating action of the actuator, the apparatus including:

at least two links parallelly disposed and spaced apart from each other, each link including a first end segment, a second end segment, and an intermediate segment extending therebetween, each of the first end segment and the second end segment including an eyelet portion, and a stub portion extending integrally and contiguously from the eyelet portion, a support structure for supporting the at least two links, wherein, for each said link, the intermediate segment is coupled to the stub portion of the first end segment and to the stub portion of the second end segment by groove welding, and wherein the support structure includes:

a beam disposed between the at least two links, a first sleeve coupled to the beam and disposed around one of the at least two links with a first clearance being defined with the one of the at least two links, and a second sleeve coupled to the beam and disposed around the other of the at least two links with a second clearance being defined with the other of the at least two links.

14. The machine of claim 13, wherein the support structure further includes:

a connector piece fixedly coupled between the at least two links, and a plate fixedly coupled between the connector piece and the beam, the plate including an opening adapted to receive a tether or a cable.

15. The machine of claim 13, wherein for each link, a cross-sectional profile of the stub portion of the first end segment, a cross-sectional profile of the stub portion of the second end segment, and a cross-sectional profile of the intermediate segment, is circular.

* * * * *